United States Patent [19]

Drachnik et al.

[11] Patent Number: 4,855,024

[45] Date of Patent: Aug. 8, 1989

[54] MESH ELECTRODES AND CLIPS FOR USE IN PREPARING THEM

[75] Inventors: Kenneth J. Drachnik, Fremont; Joseph Kheder, Newark; S. Alan Aspey, Saratoga, all of Calif.

[73] Assignee: Raychem Corporation, Menlo Park, Calif.

[21] Appl. No.: 119,612

[22] Filed: Nov. 12, 1987

Related U.S. Application Data

[63] Continuation-in-part of Ser. No. 908,459, Sep. 16, 1986, abandoned.

[30] Foreign Application Priority Data

Sep. 15, 1987 [EP] European Pat. Off. ..... 87308145.9

[51] Int. Cl.[4] ..... C23F 13/00

[52] U.S. Cl. ..... 204/147; 204/196; 204/279; 204/284

[58] Field of Search ..... 204/147-148, 204/196-197, 279, 284; 445/46

[56] References Cited

U.S. PATENT DOCUMENTS

| | | | |
|---|---|---|---|
| 3,475,304 | 10/1969 | Currey | 204/196 X |
| 3,863,416 | 2/1975 | Oroschakoff | 52/646 |
| 4,118,836 | 10/1978 | Duboc et al. | 204/279 |
| 4,154,429 | 5/1979 | Brannan | 256/10 |
| 4,154,430 | 5/1979 | Pfarr, Jr. | 256/10 |
| 4,255,241 | 3/1981 | Kroon et al. | 204/196 X |
| 4,298,445 | 11/1981 | Warne | 204/284 X |
| 4,502,929 | 3/1985 | Stewart et al. | 204/147 |

FOREIGN PATENT DOCUMENTS

| | | | |
|---|---|---|---|
| 0147977 | 7/1985 | European Pat. Off. . | |
| 2140456 | 1/1984 | United Kingdom . | |
| 86/06759 | 11/1986 | World Int. Prop. O. | 204/196 |

OTHER PUBLICATIONS

Stratfull, Richard F., "Knowlege and Needs in the Field of Impressed Current Cathodic Protection: System Control and Monitoring", presented to FHWA Dec. 1979.

*Engineering News-Record,* Jul. 11, 1985, "Deck Protected by Wire Grid".

Engineering News-Record, "Stopping Bridge Rebar Corrosion", Jun. 14, 1984.

Ferex TM 100-Cathodic Protection Anode for the Prevention of Corrosion in Concrete.

*Primary Examiner*—Donald R. Valentine

*Attorney, Agent, or Firm*—Timothy H. P. Richardson; Herbert G. Burkard

[57] ABSTRACT

Mesh anodes, particularly suitable for use in the cathodic protection of reinforcing bars in concrete, make use of resiliently deformable conductive clips. The clips secure together portions of the same or different elongate electrodes at spaced-apart junctions of a mesh formed by the electrode(s), thus providing electrical and mechanical connection between the electrode portions at the junctions.

17 Claims, 6 Drawing Sheets

MESH ELECTRODES AND CLIPS FOR USE IN PREPARING THEM

CROSS-REFERENCE TO RELATED APPLICATION

This application is a continuation-in-part of copending commonly assigned application Ser. No. 908,459 filed Sept. 16, 1986, by Drachnik and Kheder, now abandoned, the entire disclosure of which is incorporated herein by reference.

BACKGROUND OF THE INVENTION

1. Field of the Invention

This invention relates to anodes suitable for use in corrosion protection systems, especially for the protection of reinforcing bars ("rebar") in concrete.

2. Introduction to the Invention

Anodes for use in corrosion protection systems are disclosed for example in U.S. Pat. Nos. 4,520,929 (Stewart), 4,473,450 (Nayak), 4,319,854 (Marzocchi), 4,255,241 (Kroon), 4,267,029 (Massarsky), 3,868,313 (Gay), 3,789,142 (Evans), 3,391,072 (Pearson), 3,354,063 (Shutt), 3,022,242 (Anderson), 2,053,314 (Brown) and 1,842,541 (Cumberland), UK Patent Specification Nos. 1,394,292 and 2,046,789A, Japanese Patent Specification Nos. 35293/1973 and 48948/1978, and European Patent Application No. 0,147,977. Especially for the corrosion protection of reinforcing bars in concrete, mesh anodes are particularly suitable. However, the known mesh anodes are not satisfactory. Either they are difficult to manufacture (especially if they are to be manufactured, in whole or in part, at the installation site, e.g. on the surface of a reinforced concrete structure), or damage caused by physical abuse or by corrosion failure, at one or only a few locations of the anode, can disconnect large portions of the anode from the power supply.

SUMMARY OF THE INVENTION

We have now discovered that these disadvantages can be overcome through the use of resiliently deformable clips which secure together portions of the same or different elongate electrodes at spaced-apart junctions of a mesh formed by the electrode(s), and provide both electrical and mechanical connection between the electrode portions at the junctions. It is not necessary that such clips be provided at each of the junctions of the mesh, though it is preferred. The clips initially provide a convenient and rapid method of securing the elongate electrode(s) in the desired mesh configuration. They may continue to provide this function if no other measure is taken to preserve the mesh configuration (e.g. a layer of concrete applied directly or indirectly over the anode after it is in place). The clips need not play any substantial electrical part in the operation of the anode if the anode is undamaged. But if the anode is damaged, so that current can no longer flow directly to all parts of the anode through the elongate electrode(s), the clips provide an alternative current path so that substantially the whole of the anode remains operational. The fact that the clips are resiliently deformed not only helps them to remain effective when (as is preferred) the anode is flexible, but also helps to ensure that they provide good electrical connection both initially and in subsequent operation if a dimension of the elongate electrode changes, e.g. through electrochemical erosion. This can be particularly important if, as is preferred, the elongate electrode comprises a conductive polymer (i.e. a dispersion of carbon black or graphite or other corrosion-resistant particulate filler in a polymeric matrix) especially if the electrode has been made by a process, e.g. a melt-extrusion process, which results in a resin-rich surface layer (i.e. a surface layer containing a relatively small proportion of the filler). The pressure exerted by the clip on the electrode portion is generally at least 0.01 psi (0.0007 kg/cm$^2$), preferably at least 0.05 psi (0.0035 kg/cm$^2$), but is generally less than 10 psi (0.7 kg/cm$^2$), preferably less than 5 psi (0.35 kg/cm$^2$), e.g. 0.1–1 psi (0.007–0.07 kg/cm$^2$).

In one aspect, the present invention provides a mesh electrode which is suitable for use as an anode in a corrosion protection system and which comprises (1) one or more elongate electrodes arranged in the form of a mesh having a plurality of spaced-apart junctions at which portions of the elongate electrode or electrodes are secured together, and (2) a plurality of clips, each of the clips providing mechanical and electrical connection between the electrode portions at one of said junctions, the electrical connection with each electrode portion being over an electrical contact area of at least 25 mm$^2$, preferably at least 50 mm$^2$, particularly at least 100 mm$^2$, more particularly at least 200 mm$^2$, especially at least 300 mm$^2$, and the connection being maintained by resilient bias so that if the size of the connected electrode portions is reduced, such mechanical and electrical connection is maintained by elastic recovery of the clip.

In another aspect, the invention provides a method of making such a mesh electrode which comprises:

(1) laying out one or more elongate electrodes in a desired mesh pattern, preferably on the surface of a concrete structure containing reinforcing bars, and (2) connecting the electrode portions at the junctions of the mesh by resiliently deforming the clips around said portions.

In another aspect, the invention provides a method of cathodically protecting a corrodible substrate, particularly reinforcing bars embedded in concrete, which comprises establishing a potential difference between the substrate as cathode and a mesh anode as defined above.

In another aspect, the invention provides a method of rendering a reinforced concrete structure suitable for cathodic protection of the reinforcing bars therein, which method comprises securing a mesh electrode as defined above to the surface of the structure.

In another aspect, the invention provides a clip suitable for use in the manufacture of a mesh anode as defined above, the clip comprising (1) electrical interconnection means which has at least two recesses, each of the recesses having an exposed surface composed of a conductive material and being capable of receiving and electrically contacting an electrode portion over a surface area of at least 25 mm$^2$, said exposed surfaces being electrically connected to each other; and (2) mechanical interconnection means which restrict movement between the recesses and which can maintain said electrical contact by resilient bias.

BRIEF DESCRIPTION OF THE DRAWINGS

The invention is illustrated by the accompanying drawing in which

FIGS. 4 to 16 illustrate various clips useful in constructing a mesh electrode of the invention, FIGS. 4, 7 and 13 to 15 being shown in perspective and FIGS. 5, 6 and 8 to 12 being shown in cross-section; and FIG. 17 is a perspective view of a clip useful with the mesh electrode of FIG. 3B.

DETAILED DESCRIPTION OF THE INVENTION

The exposed conductive surfaces of the recesses need not provide the whole of the surface of the recess which contacts the electrode portion. In one embodiment, the clip is composed entirely of a conductive polymer. However, in such a clip it is difficult to provide a satisfactory compromise between the desired attributes of low electrical resistance and high physical strength and resilience. In another embodiment, therefore, the clip comprises an element which is composed of a conductive polymer and which provides at least part of each of the recesses, e.g. a bridging member between the recesses, and has for example a resistivity of 1 to 5 ohm.cm, with the remainder of the clip being composed of a less conductive or non-conductive polymeric material. In another embodiment, the electrical interconnection means is provided by a non-polymeric corrosion-resistant material, e.g. a foil or mesh or wire having at least an outer surface which is composed of a noble metal, e.g. niobium, titanium or stainless steel. The expense of most such materials is so great that it is not practical to construct the entire clip from them. Instead the material provides a partial or complete lining for each of the recesses, and a bridge between the recesses, and the rest of the clip is composed of a non-conductive material, preferably a polymer, which provides the desired mechanical interconnection means, including the resilient bias. In all of the clips, it is possible to provide a deformable, usually a non-elastically deformable, conductive material, e.g. a conductive mastic or grease, within the recesses of the clip, to improve electrical contact between the clip and the electrode.

The invention is illustrated by the accompanying drawings. In the following description of the invention with reference to the drawings, it is to be understood that the various features which are illustrated in or discussed with reference to a particular Figure or Figures are also applicable, with any necessary or appropriate changes, to other embodiments of the invention, whether or not illustrated in the Figures, as broadly disclosed herein.

Figure 1:
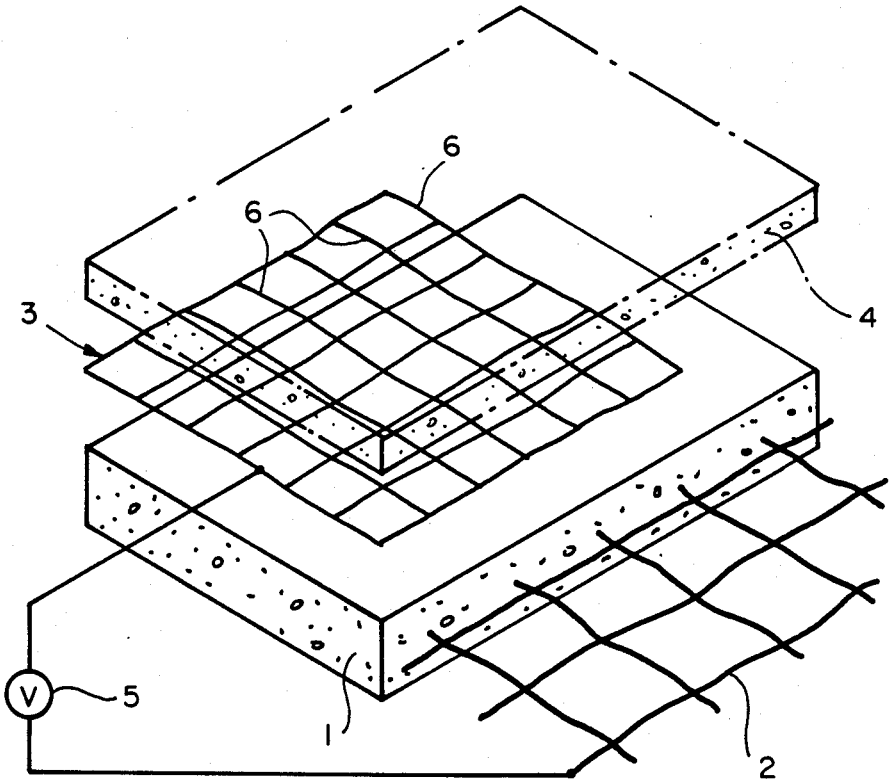
FIG. 1 is an exploded view of a rebar-reinforced concrete slab which incorporates a mesh electrode of the invention.

The invention is particularly applicable to cathodic protection of reinforcements in concrete, as illustrated in FIG. 1. FIG. 1 shows concrete 1, reinforced by rebars 2 which are shown partially exposed for illustrative purposes.

An electrode 3, as anode, is placed on a surface of the concrete 1 and an overlay 4 generally of a conductive material, particularly an ionically conductive material, is applied. Material 4 may comprise concrete or cement, conductive concrete or cement, plaster-based material or polymeric material. Particular examples are Portland cement concrete and asphalt concrete, or Portland cement modified concrete (for example latex or acrylic modified concrete). A potential difference is applied between electrode 3 as anode and the rebars 2 as cathode by means of a power source 5.

The electrode 3 is preferably in the form of a mesh, and is preferably flexible. The minimum dimension of the apertures of such a mesh (i.e. the shortest side of the aperture) will generally be at least 0.5 inch (1.3 cm), preferably at least 1 inch (2.5 cm), particularly at least 2 inches (5.0 cm), more particularly at least 4 inches (10.0 cm), especially at least 6 inches (15 cm). The maximum dimension of the aperture (i.e. the length of the longest side of the aperture) will generally be less than 48 inches (120 cm), particularly less than 24 inches (60 cm), and for some applications less than 8 inches (20 cm). Preferably the shortest and longest sides of the apertures differ by less than a factor of about 3, especially less than about 2. The apertures in the mesh can be of any shape, e.g. substantially square or other substantially rectangular shape. The size and shape of the apertures will usually be substantially the same throughout a particular mesh, but they may be different. By mesh, we mean merely an array where adjacent elements are connected together, for example by them being integral and looped, or being connected together by conductive clips etc. Generally, a given element may be connected to an adjacent element at more than one location, but this need not be so.

The mesh is preferably flexible, this term being used herein to mean that it can be bent, along at least one axis, and preferably along two perpendicular axes, through an angle of 180° around a round mandrel of diameter 12 inches (30 cm), and preferably around a round mandrel of diameter 6 inches (15 cm), without suffering damage. This property results in a very significant advantage, namely that the mesh can easily be transported in rolls to an installation site, and can be installed in a wide variety of different situations with a minimum of difficulty.

In order to provide such flexibility, the electrode elements 6 of which it is at least in part composed may be flexible. Where the electrode elements 6 run in substantially perpendicular directions, those in only one, or those in both, directions may be flexible.

Flexibility may, however, result from or be enhanced by the construction of the electrode from its elements. For example the configuration of the elements, and the way they are held together will affect flexibility. In particular we prefer that where a clip is used to hold together portions of the electrode element or elements, that clip allows some movement, for example rotational movement.

Figure 2:
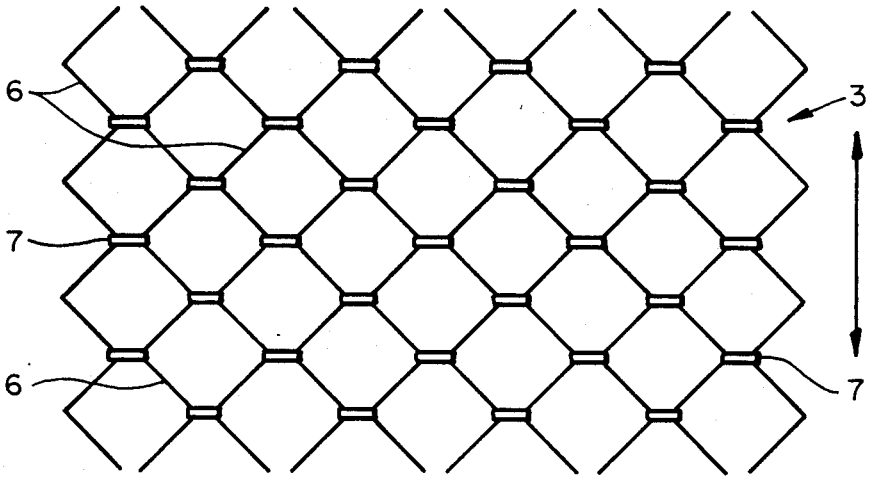
FIG. 2 is a plain view of the mesh electrode.

The anode 3 illustrated in FIG. 2 comprises a series of electrode elements 6 of generally zig-zag shape. Each electrode element 6 is interconnected to an adjacent element by means of a clip 7 positioned at each peak of the zig-zag pattern. It can be seen that this electrode 3 will be flexible in that it could be rolled around a mandrel whose axis was parallel to the length of the arrow, without need for the elements 6 themselves to be flexible (the depth of the zig-zag may be small) This flexibility may result from an ability of the clips 7 to bend, or from an ability of the elements 6 to rotate in the clips. In FIG. 2, each element 6 is independent of all of the others except for the clips 7. It will therefore be necessary for the clips 7 to provide electrical interconnection between the elements, if the desired substantially uniform potential is to exist over the entire surface of the electrode. It will not in general be necessary for clips 7 to be employed at every available position, as illustrated.

Figure 3:
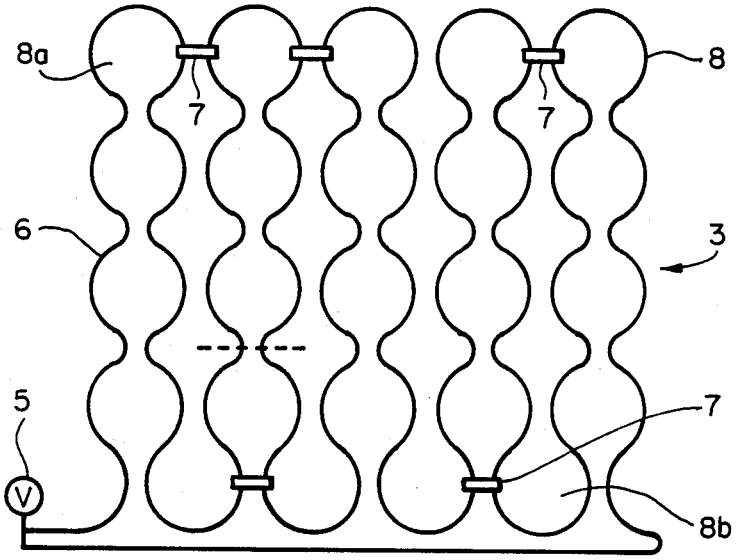
FIGS. 3A and 3B show plain views of alternative mesh electrode designs.

A different design of electrode mesh is shown in FIGS. 3A and 3B; here a single electrode element 6 is configured in a series of loops 8*a* and 8*b* over the desired area to which an electrical potential is to be applied. In FIG. 3A, clips 7 are positioned such that each of the loops is connected at or adjacent its distal end to another portion of the electrode (generally to an adjacent loop). ("Distal" in general means far from a point of attachment, and in the present context therefore means, in relation to any given loop, that part of the loop remote from those parts of the element forming it that attach that loop to, for example, adjacent loops.) In FIG. 3A, five clips 7 have been used with the nine loops (reckoned by regarding loops 8*a* and 8*b* as separate) to ensure that any double cut, such as that shown by the dotted line, does not isolate any part of the electrode, so long as the power 5 is supplied to both ends as shown. Such a double cut may occur in practice since two portions of an electrode element may be close at many points. Damage may occur for example in the case of concrete bridges through road work etc. It can be seen that the double cut shown by the dotted line will isolate none of the illustrated electrodes even if it is powered through one only of the two ends; there are however some positions where a double cut would then isolate some part of the electrode, but this can be avoided by employing more clips. It may be noted that the number of clips that achieves this preferred level of protection is five as illustrated, i.e. equal to the number of loops 8*a*.

In FIG. 3B several novel features are shown, including the configuration of the electrode mesh, and arrangement whereby loops thereof are bussed, and the use of curved clips 7A.

The electrode element 6 is configured into a plurality of loops 8*a* and 8*b*, interconnected by portions 8*c* that are substantially straight along their entire length (in FIG. 3C the interconnecting portions were curved or zig-zag). The peaks, or other portions, or each loop may be bussed by an extension of the electrode element 6*a*, or other bus 6*b*. In the embodiment illustrated, the loops 8*a* are interconnected by an extension of the electrode element 6*a*, and the loops 8*b* by a separate bus 6*b*. This need not be so, and both sets may be bussed by separate busses, or both by extensions of the electrode element. One end of the electrode element 6 (or a bus) is connected to a power source 5, and the other end (or another bus) may also be connected to the source 5 via a portion of the element 6 near the first end, as shown at clip 7*b*.

A third feature shown in FIG. 3B is the curved clips 7*a*, whose function is to help maintain the desired configuration of the loops 8*a* and 8*b*. These clips 7*a*, which are illustrated in more detail in a later figure, may serve also to secure the electrode to a bridge deck or other substrate to be cathodically protected, and may serve also to help locate clips 7 by means of which electrical connection is made between loops 8*a*,8*b*, and busses 6*a*,6*b*.

In addition to clips 7 connecting the loops and the busses, clips 7 may be provided for electrical connection between interconnecting portions 8*c*. As in the previous embodiment, the number of clips 7 used will in general depend on the degree of redundancy required. "Redundancy" in this context means the extent to which electrode element 6 may be accidentally severed whilst retaining all of it (or a desired portion of it) powerable. We prefer that the two interconnecting portions 8*c* at each edge of the overall structure are interconnected by clips 7 spaced about by a distance X of no more than 20 ft., particularly 15 ft., especially 12 ft. Connection between other pairs of interconnecting portions may also be provided. For a typical installation, at least 10 clips 7 would be employed, preferably at least 20.

The number of clips used, will depend not only on the desired avoidance of parts of the electrode becoming isolated, but also on the resistivity of the clips and of the electrode elements 6 and on the way the electrode is powered, for example whether some form of bussing is employed. It will generally be desirable that a substantially uniform potential exist over the surface of the electrode, and this may be facilitated by the provision of a larger number of clips than that desired to prevent isolation. Also, two or more clips may be positioned adjacent one another. The above considerations apply in general to other electrode configurations, and the following discussion of preferred designs of clip applies to these and other electrode configurations.

Figure 11:
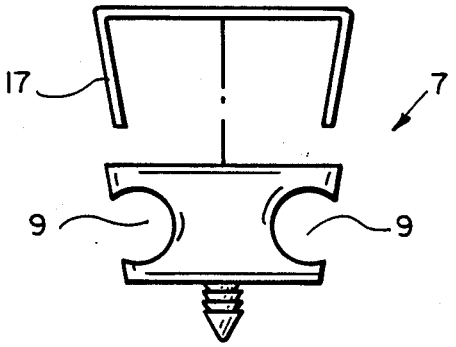
Figure 12:
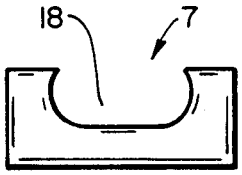
Figure 13:
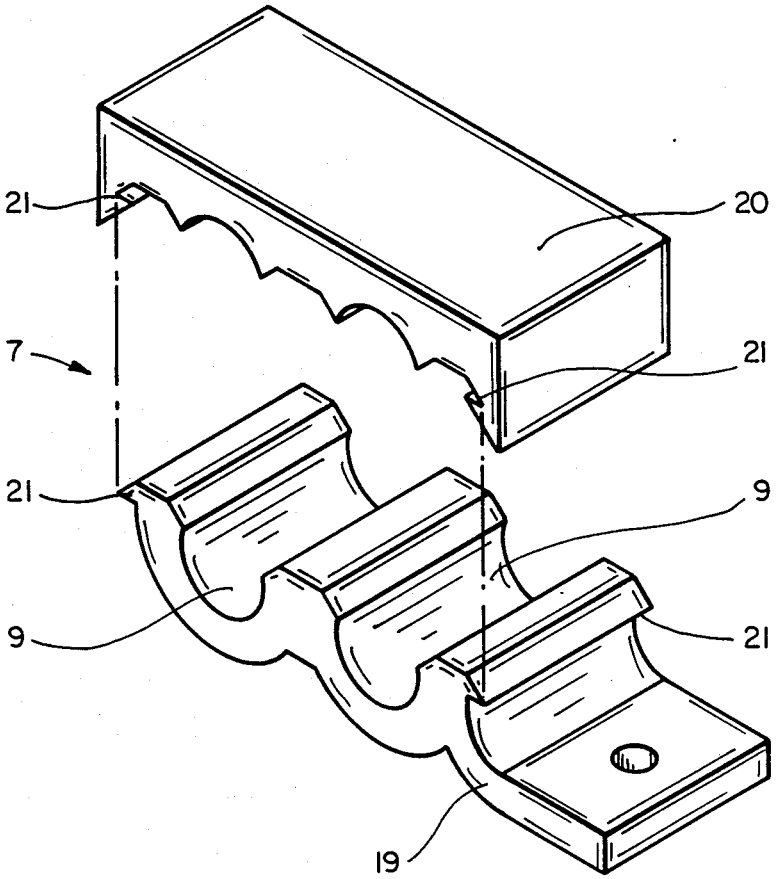
Figure 14:
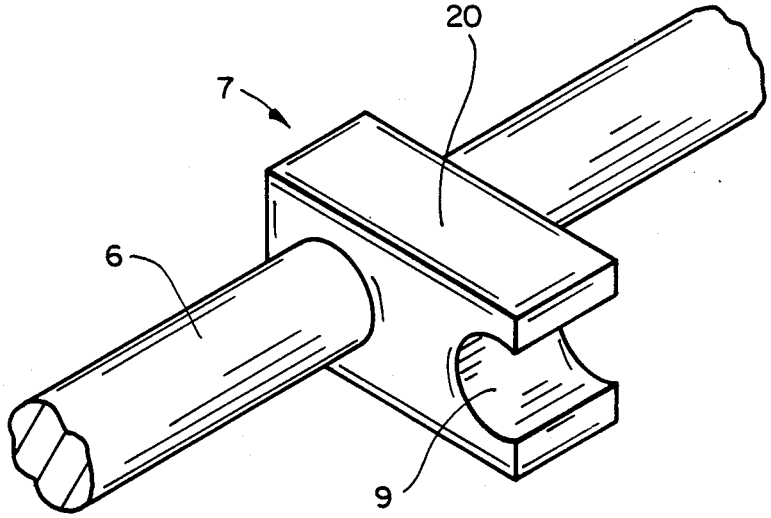

FIGS. 4–15 illustrate various clips, FIGS. 13 and 14 showing clips in conjunction with electrode elements. Any of various features illustrated and discussed may be combined with any other, and any clip illustrated or discussed may comprise a conductive polymer and/or may comprise electrical interconnection means (preferably contacting each of two electrode elements over surface areas of at least 25 $mm^2$ more preferably at least 50 $mm^2$) and mechanical interconnection means (preferably restricting movement between electrode portions and maintaining an electrical contact by resilient bias). Where carbon black is used as a filler, we prefer at least 40% especially at least 50% of carbon black of particle size 0.1 mm or less, especially 0.01 mm or less. Other fillers include fibrous fillers (generally up to 30%) such as carbon fibre of fibre length 6 mm or less, graphite and metal oxides.

Figure 4:
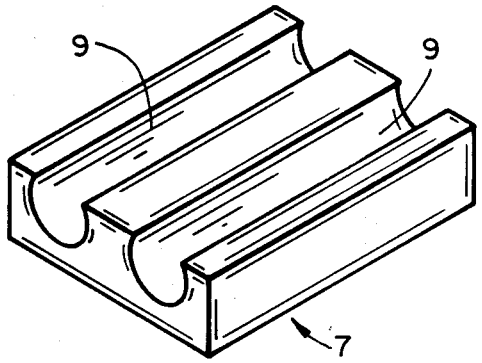

FIG. 4 shows a clip 7 having means 9, particularly recesses, for locating portions of electrode elements. The mouth of each recess is preferably slightly smaller than the electrode portion that it is to receive, such that the electrode is a snap fit within the clip and will not fall out. Also, we prefer that the cross-sectional size of the recesses 9 is sightly smaller than the electrode portions such that the clip applies some pressure to the portion. Thus, the clip, which preferably comprises a conductive material provides an electrical connection between two electrode portions, which connection is maintained by resilient bias due to elasticity or resilience of the clip and the small size of the recesses. Thus, the means for electrical interconnection and for mechanical interconnection are both provided by a single piece of conductive, resilient material. The clip preferably allows rotation of the electrode portions, and the portions and the recesses are therefore preferably substantially circular in cross-section. We prefer that each clip has only two recesses, but more than two recesses may be preferred for some applications.

Where the electrode portions have an electrochemically active surface, it may be desirable that chemical action at that portion which contacts the clip be retarded in order that a good contact remain between that portion and the clip. A good contact between clip and electrode portion will not only improve electrical contact, but may reduce chemical degradation of electrode (and of the clip where appropriate) since electrolyte will be prevented or hindered from reaching the contacting surfaces. If desired the contacting surfaces may be coated with some electrochemically inactive material to help maintain contact. The extent to which such an electrochemical reaction need be retarded will be reduced if elasticity of the clip (or of the electrode portion) is sufficient to compensate for significant reduction in size of the portion and/or increase in size of the recess 9.

The surface area of the recess (or other contact area) is preferably at least 25 $mm^2$ more preferably at least 50 $mm^2$, more preferably at least 100 $mm^2$, particularly at least 200 $mm^2$, especially at least 300 $mm^2$. The value chosen will depend on the tendency of the materials in question to react and on their resistivity.

We prefer that the resistance of the clip (by which we mean the resistance it offers between two electrode portions when positioned in respective recesses or otherwise properly located) is preferably 25 ohms or less, more preferably 15 ohms or less, particularly 10 ohms or less, especially 5 ohms or less, more especially 3 ohms or less. Where two or more clips join the same portions together with substantially no space between them, these values refer to their resistance in combination.

Where the electrode is used under conditions that it is an anode, it will be desirable that the clips do not corrode, or do so at a reasonably slow rate, especially at least as slowly as that of the electrode portions. One preferred material for at least a portion of the clips is therefore a conductive polymer. Others are non-conductive polymers, carbonaceous materials and noble metals. A preferred polymer comprises an olefinic polymer such as polyethylene, which may be cross-linked.

If desired, the clip may be dimensionally-recoverable, for example heat-shrinkable, such that on heating or other treatment, the recesses 9 close around electrode portions producing good electrical contact and restricting ingress of electrolyte.

The dimensions of the clip shown in FIG. 4 are preferably 0.5–10 mm, more preferably 1–5 mm thickness of material between the two recess and between each recess and the base, and 5–100 mm, more preferably 10–50 mm in length (i.e. along the recesses).

The clip may be used to interconnect two similar or two different electrode portions. For example, one may comprise a carbonaceous anode portion and another may comprise, for example, a titanium or platinum anode. One or both of the recesses may be used to hold a power supply wire or cable, or to hold a splice between two wires or cables. The clip may be used as the means by which power is applied to the electrode. For example, a cable supplying power may be stripped of insulation at its end, or an end portion thereof otherwise rendered conductive at its outer surface. That end is then located with respect to the clip, by placing it in the recess 9 or otherwise. The conductive clip, now live, is then connected to some convenient portion of the electrode. One way of terminating the power supply cable for this purpose is to remove its insulation, and then build the revealed conductor up to the correct diameter for location in the recess by means of a conductive (for example conductive polymer) plug or wrap (such as a tape wrap). The plug or wrap may be held in place by heat shrinking some locating means such as a sleeve over the cable end and bridging the plug or wrap. More simply, perhaps, the plug could be of a heat-shrinkable conductive polymer.

Figure 5:
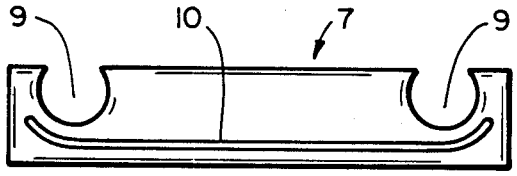

FIG. 5 shows a clip having means 10 for reducing the resistance between the two recesses Such means may comprise a metal set within the clip as shown. The metal has a low resistivity and the conductive polymer provides a less corrosive coating This idea can be taken further by providing a clip (which may be more or less in strip rather than block form), and coat it with a polymeric, and therefore inert, coating at all regions except where it will contact the electrode elements, at which regions the coating may be either absent or may comprise a conductive polymer.

Figure 6:
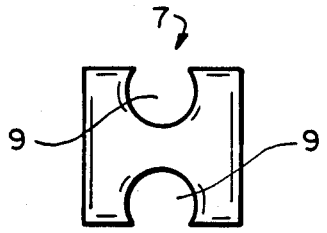

FIG. 6 shows a clip 7 of similar design to that of FIG. 4, except that recesses 6 are disposed on opposite faces.

Figure 7:
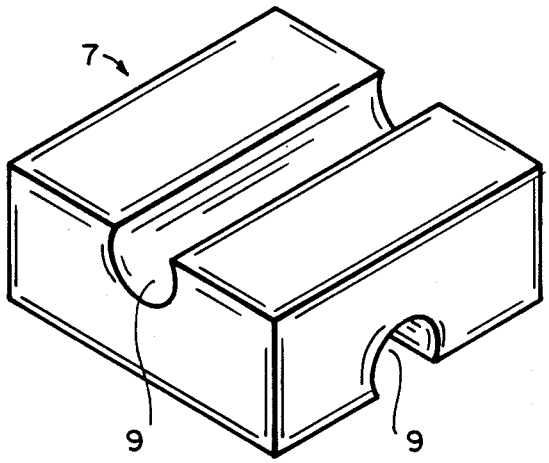

In FIG. 7, recesses 9 are provided on opposite faces, and are mutually perpendicular. Such a design may be useful for a mesh electrode having rows and columns of perpendicular electrode elements, such as that shown in FIG. 1.

Figure 8:
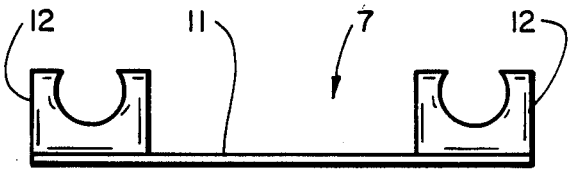

The clip of FIG. 8 comprises a base 11 and two blocks 12, each of which has a recess for an electrode portion. The base 11 may be flexible.

Figure 9:
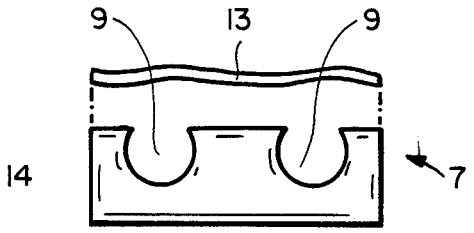

In FIG. 9 the functions of electrical interconnection and mechanical interconnection have been split between a conductive member 12 and a block 14. The block 14 may deform the member 12 around the electrode members and hold it in place.

Figure 10:
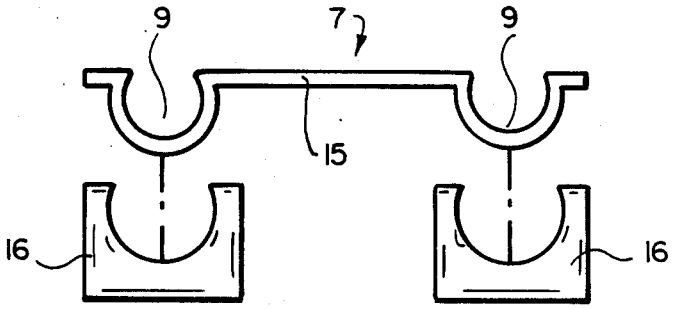

In FIG. 10, the member 15 provides electrical interconnection and some mechanical interconnection. The blocks 16 serve merely to locate the member 15 with respect to the electrode portions. If member 15 is a metal, it should preferably be a passivating metal such as titanium, tantalum, or niobium.

FIG. 11 shows an additional securing means 17 which may retain or help to retain the electrode portions in the recesses 9. In this case, the recesses need not of course be reentrant (i.e. have a neck) in cross-section to stop the electrode portions falling out. FIG. 11 also shows means such as a pin extending from the base of the clip or a screw or bolt that extends through the clip, by means of which the clip maybe secured to some other article, for example a layer of concrete. Any of the clips illustrated may be provided with such a connecting means.

In FIG. 12, there is a single recess for location of two (or more) electrode members. Whilst direct electrical connection between the two members may be insignificant, due to the small area of contact, this design may provide sufficient electrical contact for some purposes although the surface contact between each electrode portion and the clip is less than in the earlier designs.

FIG. 13 shows a clip 7 having a flange 19 by means of which it may be held in position, for example against a concrete or other surface. Flange 19 may have a hole therein, as illustrated, through which a pin or bolt etc. may be driven into concrete. In another embodiment a pin etc. may be affixed to the underside of the flange 19. The clip 7 of FIG. 13 may be provided with a cover 20 which may provide additional pressure on the electrode portions that are to lie in the recesses 9. The cover 20 may but need not be electrically conductive, and it may be retained at least in part by catches 21. Where such a cover is provided recesses 9 need not have a re-entrant or necked configuration in cross-section.

In FIG. 14, the clip 22 is provided with one hole, closed in cross-section, and one recess 9. The clip has to be slid along an electrode portions 6 from its end, after which it may be clipped to another electrode portion in the usual fashion. A clip could be provided having both (or all) holes closed in cross-section, but this may make achievement of the desired mesh or other electrode configuration rather difficult. Where the design of FIG. 14 is to be used, a suitable number of clips 22 could be slid along an electrode member, the member arranged in a mesh or other configuration, and then the clips, which may need to be slid to desired positions, clipped to nearby electrode portions to stabilize the structure and electrically interconnect its various parts.

Figure 15:
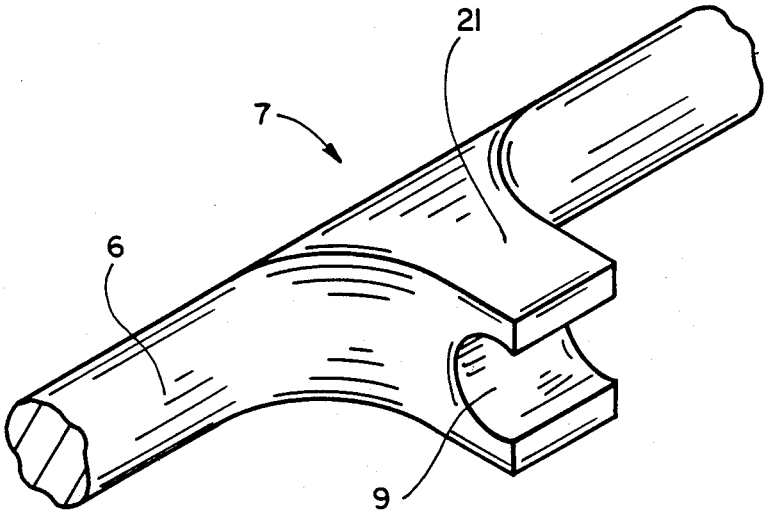

A variation of the design of FIG. 14 is shown in FIG. 15, where the clip 7 is an integral protection 23 (or is permanently joined to) the electrode portion 6.

FIG. 16 shows a preferred design of clip 7 having a central portion 24 of low resistivity, shown dotted at its end. In this way desired electrical properties may be combined with desired mechanical properties. Thus, in one embodiment, a conductive portion 24 comprising for example a conductive polymer (such as a polymer loaded with carbon black or other conductive filler) is provided within a support portion 25 which is not, or which is less, conductive. The conductive portion 24 could comprise a non-corrosive metal particularly a metal that forms a conductive oxide. Such metals, often referred to as valve metals, include titanium, palladium and platinum etc. A reason for employing such a portion 24 is that conductive polymers may under unfavourable conditions be stress sensitive, i.e. cracking or loss of resilience may occur especially under corrosive conditions. In the embodiment illustrated, a conductive material bridges electrode elements (not shown) that lie in recesses 9, and a non-conductive material holds the elements and the conductive material in electrical contact. The non-conductive (or less conductive) material preferably has an elongation under service conditions of at least 10%, more preferably at least 20%. The conductive portion 24 illustrated is shown secured to the portion 25 at least in part by an interlocking profile 26 by means of which it may be slid longitudinally or snapped transversely in place and retained. It may, however, be merely bonded, injection moulded, or otherwise fixed. Furthermore, the portion 24 may be smaller than illustrated, being merely a strip extending from one recess 9 to the other; or it may be larger, extending substantially all around one or both of the recesses 9. The portion 24 preferably has a resistivity of less than 5 ohm cm, more preferably less than 3 ohm cm. The clip 7 maybe provided with a recess 27, or other fixing means, by means of which it may be fixed to, for example, the curved clips 7*a* illustrated in FIG. 3*b* above, and FIG. 17 below.

FIG. 17 shows a clip 28 that can be used as curved clip 7*a* as illustrated in FIG. 3*b*. The clip 28 may be naturally curved, or it may be naturally straight and serve merely to ensure that a loop in an electrode does not kink, such loop being maintained in some other way. The clip 28 comprises a member 29 to which are attached (or with which are integrally formed) connection members 30 each of which having a recess 9 therein, or having means for retaining an electrode element. The electrode element is snapped or slid into the recesses. The clip 28 also has a flange, or other attachment member, 31 for securing it, and therefore the electrode element it carries, to the substrate.

The clip 7 of FIG. 16 (or other clip designs, for example of uniform construction) may be used with another clip, for example the curved clip 28 of FIG. 17. This may be done by engaging a recess 27 of the clip 7 and a portion 32 of the clip 28. The result is as shown in FIG. 3*b*, where the loops 8*a*,8*b* are connected to busses 6*a*,6*b*.

In some instances, particularly where a straight recess of a clip is to receive a curved electrode element, a conductive paste or liquid may be provided around the element within the recess to enhance electrical connection. In general, such a paste or liquid may be desirable where the configuration or size or shape of the element differs from that of the recess, or where the element is likely to be deformed after insertion in the recess.

Thus, the electrical interconnection means of the clip (when installed) may comprise a conductive liquid or paste. Paste is here used as a general term to indicate a deformable material of high viscosity that will not readily flow, and which will not therefore leach away. The paste (or liquid) preferably comprises an electrically conductive material dispersed in a fluid medium. The conductive material may comprise carbon black, especially acetylene black, graphite, carbon fibers, or metal fibers or powder particularly metals having an adhesive oxide (the so-called valve metals) such as titanium, palladium or platinum. The fluid medium is preferably repellent to undesirable fluids such as water. Preferred fluid media comprise a silicone oil, although some hydrocarbon oils are suitable. A typical loading of conductive material is 1–50%, especially 10–30%, by weight, these values being particularly suitable for acetylene black in silicone oil. These two components should be thoroughly mixed so that the black is wetted by the oil. This may take 5–10 minutes, with some shear. We prefer that the paste have a volume resistivity of less than 7 ohm cm, more preferably less than 3.5 ohm cm, particularly less than 2.5 ohm cm.

We claim:

1. A mesh electrode which is suitable for use as an anode in a corrosion protection system and which comprises (1) one or more elongate electrodes arranged in the form of a mesh having a plurality of spaced-apart junctions at which portions of the elongate electrode or electrodes are secured together, and (2) a plurality of clips, each of the clips providing mechanical and electrical connection between the electrode portions at one of said junctions, the electrical connection with each electrode portion being over an electrical contact area of at least 25 $mm^2$, and the connection being maintained by resilient bias so that if the size of the connected electrode portions is reduced, such mechanical and electrical connection is maintained by elastic recovery of the clip.

2. An electrode according to claim 1 wherein said contact area is at least 100 $mm^2$.

3. An electrode according to claim 1 wherein said contact area is at least 200 $mm^2$.

4. An electrode according to claim 1 wherein each of the clips comprises a conductive polymer portion which makes electrical connection with the electrode portions.

5. An electrode according to claim 1 wherein each of the electrodes is a flexible electrode having a surface which comprises a conductive polymer.

6. An electrode according to claim 1 wherein the pressure exerted on the electrodes by the clips in the electrical contact area is at least 0.01 psi.

7. An electrode according to claim 6 wherein said pressure is at least 0.05 psi.

8. An electrode according to claim 6 wherein the pressure exerted on the electrodes by the clips in the electrical contact area is less than 10 psi.

9. An electrode according to claim 8 wherein said pressure is less than 5 psi.

10. An electrode according to claim 8 wherein said pressure is 0.1 to 1 psi.

11. An electrode according to claim 1 wherein the resistance of the electrical connection between electrode portions at each junction is less than 25 ohms.

12. An electrode according to claim 11 wherein said resistance is less than 10 ohms.

13. An electrode according to claim 11 wherein said resistance is less than 3 ohms.

14. A method of making a mesh electrode suitable for use as an anode in a corrosion system, said mesh electrode comprising (a) one or more elongate electrodes arranged in the form of a mesh having a plurality of spaced-apart junctions at which portions of the elongate electrode or electrodes are secured together, and (b) a plurality of clips, each of the clips providing mechanical and electrical connection between the electrode portions at one of said junctions, the electrical connection with each electrode portion being over an electrical contact area of at least 25 $mm^2$, and the connection being maintained by resilient bias so that if the size of the connected electrode portions is reduced, such mechanical and electrical connection is maintained by elastic recovery of the clip which method comprises (1) laying out one or more elongate electrodes in a desired mesh pattern, and (2) connecting the electrode portions at the junctions of the mesh by resiliently deforming the clips around the said portions.

15. A method of cathodically protecting a corrodible substrate which comprises establishing a potential difference between the substrate as cathode and a mesh anode, said anode comprising (1) one or more elongate electrodes arranged in the form of a mesh having a plurality of spaced-apart junctions at which portions of the elongate electrode or electrodes are secured together, and (2) a plurality of clips, each of the clips providing mechanical and electrical connection between the electrode portions at one of said junctions, the electrical connection with each electrode portion being over an electrical contact area of at least 25 $mm^2$, and the connection being maintained by resilient bias so that if the size of the connected electrode portions is reduced, such mechanical and electrical connection is maintained by elastic recovery of the clip.

16. A method of rendering a reinforced concrete structure suitable for cathodic protection of the reinforcing bars therein, which method comprises securing a mesh electrode to the surface of the structure, said mesh electrode comprising (1) one or more elongate electrodes arranged in the form of a mesh having a plurality of spaced-apart junctions at which portions of the elongate electrode or electrodes are secured together, and (2) a plurality of clips, each of the clips providing mechanical and electrical connection between the electrode portions at one of said junctions, the electrical connection with each electrode portion being over an electrical contact area of at least 25 $mm^2$, and the connection being maintained by resilient bias so that if the size of the connected electrode portions is reduced, such mechanical and electrical connection is maintained by elastic recovery of the clip.

17. A clip suitable for use in the manufacture of a mesh electrode, said electrode comprising (a) one or more elongate electrodes arranged in the form of a mesh having a plurality of spaced-apart junctions at which portions of the elongate electrode or electrodes are secured together, and (b) a plurality of clips, each of the clips providing mechanical and electrical connection between the electrode portions at one of said junctions, the electrical connection with each electrode portion being over an electrical contact area of at least 25 $mm^2$, and the connection being maintained by resilient bias so that if the size of the connected electrode portions is reduced, such mechanical and electrical connection is maintained by elastic recovery of the clip which clip comprises (1) electrical interconnection means which has at least two recesses, each of the recesses having an exposed surface composed of a conductive material and being capable of receiving and electrically contacting an electrode portion over a surface area of at least 25 $mm^2$, said exposed surfaces being electrically connected to each other; and (2) mechanical interconnection means which restricts movement between the recesses and which can maintain said electrical contact by resilient bias.

* * * * *